United States Patent [19]

Guignard

[11] 4,287,139

[45] Sep. 1, 1981

[54] DEVICE FOR FORMING A NONWOVEN PRODUCT FROM A FLUID DIELECTRIC SUBSTANCE AND PROCESS

[75] Inventor: Claude Guignard, St-Genis Pouilly, France

[73] Assignee: Battelle Memorial Institute, Carouge, Switzerland

[21] Appl. No.: 1,254

[22] Filed: Dec. 14, 1978

[30] Foreign Application Priority Data

Dec. 22, 1977 [CH] Switzerland ..... 15840/77

[51] Int. Cl.[3] ..... B29C 6/00

[52] U.S. Cl. ..... 264/10; 118/626; 118/638; 198/691; 264/24; 264/25; 264/DIG. 46; 264/115; 264/166; 264/334; 425/6; 425/DIG. 13; 425/174.8 E; 425/436 RM; 427/14.1; 427/29; 427/32

[58] Field of Search ..... 427/25, 14.1, 29, 32; 118/621, 626, 638; 264/10, 22, 24, 165, 25, DIG. 46, 115, 166, 334; 425/174.8 R, 174.8 E, 6, DIG. 13, 436 RM; 65/2, 4 R, 4 A, 9; 198/691

[56] References Cited

U.S. PATENT DOCUMENTS

| | | | |
|---|---|---|---|
| 3,096,198 | 7/1963 | Schaffert | 427/15 |
| 3,446,610 | 5/1969 | Riedel | 65/4 R |
| 3,979,529 | 9/1976 | Rebentisch et al. | 427/25 |

FOREIGN PATENT DOCUMENTS

| | | | |
|---|---|---|---|
| 48-1466 | 1/1973 | Japan | 264/24 |
| 1484584 | 9/1977 | United Kingdom . | |

*Primary Examiner*—Bernard D. Pianalto

*Attorney, Agent, or Firm*—Prutzman, Kalb, Chilton & Alix

[57] ABSTRACT

A device for the production of a non-woven product from a fluid dielectric substance, comprising a first electrode, means for leading this electrode along a closed path, driving means to move this electrode along this path, coating means for coating this electrode with the said substance opposite a first portion of the said path, a second electrode whose surface is relatively extensive with regard to the first electrode, located opposite a second portion of the said path, an electrostatic generator connected to one of the said electrodes to establish a potential difference between them so as to create an electrostatic field capable of acting on the said substance to form a plurality of fibers in the direction of the said second electrode, characterized in that it comprises two endless transport bands mounted respectively around guide means defining two closed parallel trajectories passing near the coating means and the said second electrode, these bands being connected to the said driving means so as to move synchronously around their respective guide means, and a plurality of electrical conductive wires stretching transversely between these bands, each of these wires constituting the said first electrode as and when they pass opposite the said second electrode.

10 Claims, 3 Drawing Figures

DEVICE FOR FORMING A NONWOVEN PRODUCT FROM A FLUID DIELECTRIC SUBSTANCE AND PROCESS

BACKGROUND OF THE INVENTION

There exist various processes for directly producing a non-woven material from a fluid dielectric substance, in solution or molten, by means of forces created by an electrostatic field on this substance.

One of these processes consists in wetting an electrode with a solution of the product intended to yield the non-woven, and forming an electrostatic field between this electrode and a second electrode, so as to atomise this solution and collect small fibers on the second electrode. The electrode wetted by the solution is in the form either of a toothed wheel so as to concentrate the electrostatic field on these points, or of a ring formed by a conductive wire. In both cases, the electrode is driven to rotate around a horizontal axis of rotation and its lower part passes down into the solution so as to wet the electrode as it rotates.

The yield from this process is low insofar as about 80 to 99% of the substance atomised in the electrostatic field is constituted by the solvent. Moreover, the devices for putting this process into operation only allow very small quantities of solution to be atomised. Finally, the width of the non-woven product obtained from such a device is necessarily reduced. It has been proposed to put several co-axial rings in parallel. However, such a solution gives rise to problems relating to the homogeneity of the non-woven product.

British Pat. No. 1,484,584 describes another process starting with a thermoplastic dielectric substance, which is melted and brought into an electrostatic field. The advantage of this process resides in the fact that it makes it possible to produce fibers without the use of a solvent and that a plurality of fibers are formed simultaneously from a layer of the molten substance. Consequently, its yield is greater than that of the above-mentioned process. However, the means for carrying out this process, constituted in particular by an endless wire electrode driven so as to move along its closed trajectory, has a limited interest from the industrial point of view because of the width of the product which can be obtained and the speed of production.

Moreover, in that Patent, the formation of the layer of molten material on the surface of the wire electrode is obtained by the passage of this electrode through a mass of molten material placed in a container, the opposite sides of which are pierced with respective openings so as to permit the wire to pass through this container and to leave it covered with a layer of molten material extruded through the outlet opening for the wire. On leaving the container, the extruded matter covering the electrode is subjected to the electrostatic field and a plurality of fibers are formed along the layer of this material. The centering of the wire electrode in the outlet opening controls the regularity of the thickness of the layer surrounding the electrode and, to a great extent, the quality of the fibers obtained. Moreover, the even heating of a large mass of molten material is difficult to achieve. The difficulty in obtaining a perfect centering of the electrode and the even heating of the material is no doubt one of the causes of irregularities found in the non-woven product obtained by means of this device.

SUMMARY OF THE INVENTION

A particular object of the invention is to provide a solution which makes it possible to envisage a considerable improvement of the yield of these processes while retaining a great simplicity in the means used which constitutes one of the main attractions of these processes. This invention has equally as an object an improvement in the quality of the product obtained.

By means of the invention, a relatively large amount of non-woven product can be obtained, having an area whose surface, both in length and in width, can be controlled within wide limits.

For this purpose, the invention provides a device for the production of a non-woven product from a fluid dielectric substance, comprising a first electrode, means for leading this electrode along a closed path, driving means to move this electrode along this path, coating means for coating this electrode with the said substance opposite a first portion of the said path, a second electrode whose surface is relatively extensive with regard to the first electrode, located opposite a second portion of the said path, an electrostatic generator connected to one of the said electrodes to establish a potential difference between them so as to create an electrostatic field capable of acting on the said substance to form a plurality of fibers in the direction of the said second electrode, characterised in that it comprises two endless transport bands mounted respectively around guide means defining two closed parallel trajectories passing near the coating means and the said second electrode, these bands being connected to the said driving means so as to move synchronously around their respective guide means, and a plurality of electrical conductive wires stretching transversely between these bands, each of these wires constituting the said first electrode as and when they pass opposite the said second electrode.

The invention also provides a process for the production of a non-woven product from a fluid dielectric substance, comprising forming a coating of the substance on a plurality of electrical conductive wires forming first electrodes stretching transversely between two endless transport bands, driving the bands synchronously to move the coated wires successively past a second electrode whose surface is relatively extensive with regard to the wires and establishing a potential difference between each wire (while it passes the second electrode) and the second electrode so as to create an electrostatic field which acts on the dielectric substance to form a plurality of fibers which are deposited as a non-woven web on the said surface of the second electrode.

BRIEF DESCRIPTION OF DRAWINGS

The accompanying drawing illustrates very diagrammatically and by way of example, one embodiment and one variant of the device which is the subject of the invention.

DESCRIPTION OF A PREFERRED EMBODIMENT

Figure 1:
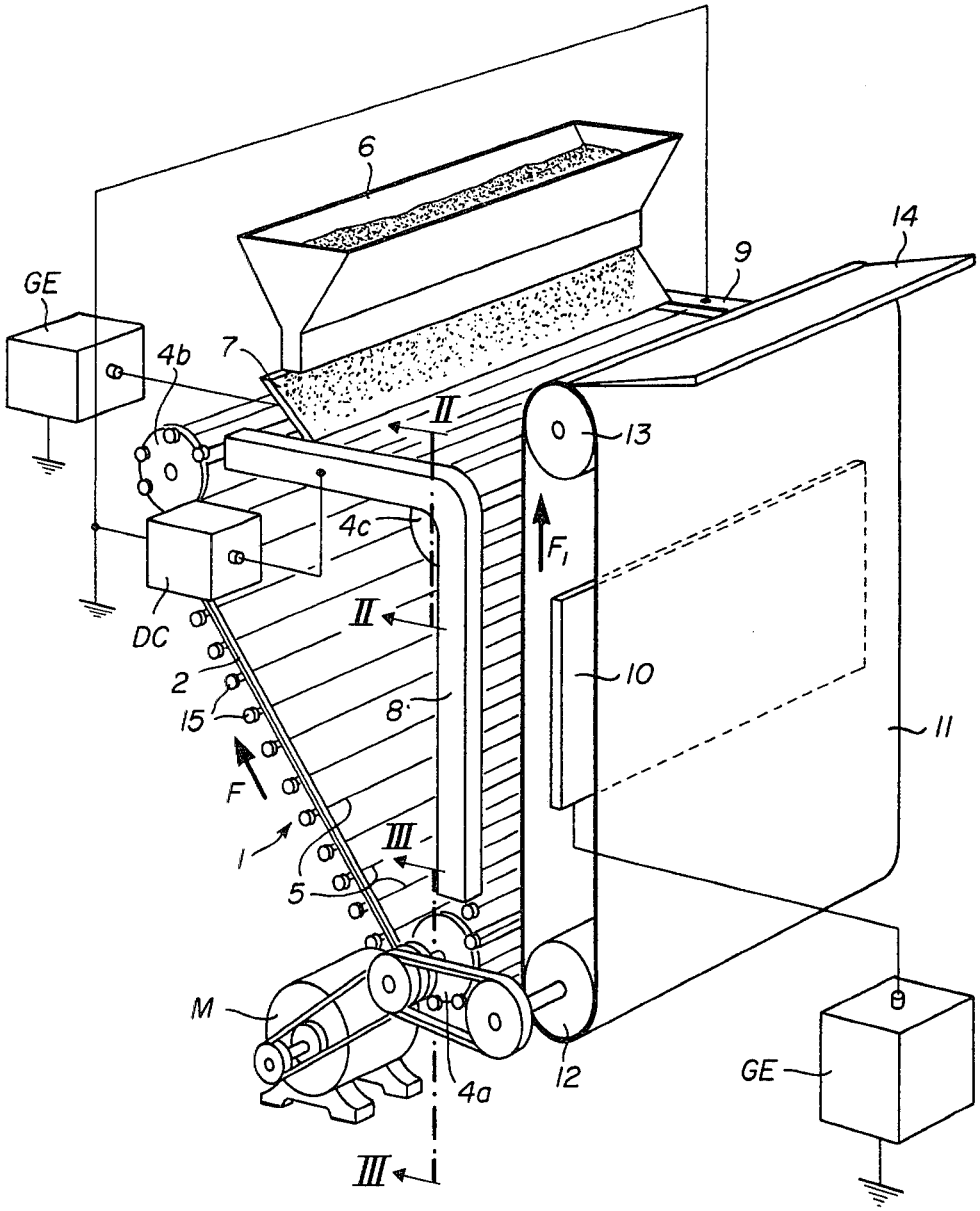
FIG. 1 is a perspective view of this device.
Figure 2:
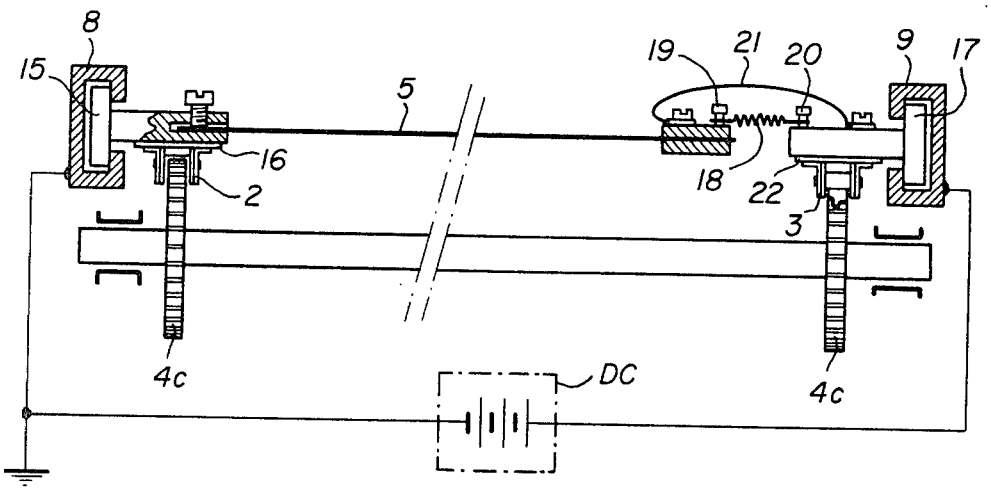
FIG. 2 is an enlarged section along II—II of FIG. 1.

The device shown in FIG. 1 comprises a feed device 1 comprising two endless parallel chains 2 and 3, mounted on three pairs of guide sprockets 4a, 4b and 4c, arranged at the apexes of a triangle of which 4a is in driving relationship with the drive shaft of a motor M. Electrically conductive wires 5 are stretched transversely between the two chains 2 and 3, and constitute a plurality of electrodes. These wires are intended to be heated by a Joule effect by means of a source of low tension continuous current (DC) and two feed rails 8 and 9 (FIG. 2). The detailed arrangements of these wires 5 will be described below. A fixed electrode formed by a metal plate 10 is placed opposite one side of the triangle formed by the feed device 1 and is connected to the negative terminal of an electrostatic generator GE adapted to deliver a current at a voltage which can be controlled between about 20 and 50 kV.

When the material used is a thermoplastic material made into a non-woven product according to the process described in British Pat. No. 1,484,584, an electrostatic powdering station is placed at one location of the trajectory of the wires 5. This station essentially comprises a hopper 6 associated with a vibrator (not shown), an electrode 7 connected to the negative potential of an electrostatic generator GE and placed at the outlet of hopper 6. This electrode is intended to impart an electrostatic charge to the powder contained in the hopper 6 and consisting of a dielectric and thermoplastic material such as polypropylene, polyethylene, polystyrene, polyvinyl chloride, a poly amide, polyester, etc.

An endless transfer band 11 is stretched between two rollers 12 and 13 insulated from the mass and extends on both sides of the electrode 10, one of its portions passing between that electrode and the portion of the feed device 1 which extends between the sprockets 4a and 4c. This portion of the transfer band forms the receiving surface for the fibers, and the band carries the non-woven product formed by these fibers deposited on this band towards a storage zone (not shown). For this purpose roller 12 is connected to motor M, and a scrapper 14 adjacent the roller 13 detaches the non-woven product as the transfer band 11 moves along.

As a variant, the endless transfer band 11 can be replaced by a non-recyclable substrate intended to be coated with a layer of non-woven and serving in that case as a permanent support for such layer. In this case, the scraper 14 is omitted and the substrate is taken from the roller 13 towards a storage zone. The respective motions of the adjacent portions of the feed device 1 and of the transfer band are preferably in opposite directions in such a way as to facilitate a homogeneous deposit. The relative speeds of this device and of this band 11 are selected in accordance with the desired thickness of the non-woven product.

FIG. 2 shows in greater detail the way in which the wires 5 are mounted as well as the way in which they are supplied with continuous current. One end of each of the wires 5 is fixed to a contact brush 15 intended to engage the feed rail 8 which is itself connected to one of the terminals of the source of continuous DC current. This contact brush 15 is secured to the chain 2 with interposition of an electrically insulating material 16. The other end of each of the wires 5 is secured to a second contact brush 17 via an elastic stretcher 18 hooked on pins 19 and 20 which are secured respectively to wire 5 and to contact brush 17, at least one of these pins being of an electrically insulating material. The purpose of the stretcher 18 is to compensate for the lengthening of the wire 5 due to its being heated by a Joule effect. A flexible electrical conductor 21 secured to the brush and to the wire 5 connects this wire electrically to the other terminal of the source of continuous current via brush 17 and rail 9. Like brush 15, brush 17 is secured to the chain 3 via an electrically insulating material 22.

This arrangement makes it possible to heat the wires over the desired portion of the closed path described by the feed device 1, this portion being defined by the length and the location of the rails 8 and 9.

The operation of the device described is as follows.

A dielectric thermoplastic material in the powder form, from which it is desired to make a non-woven product, is put into the hopper 6. The powder leaving this hopper is electrostatically charged by contact with electrode 7. The powder thus charged is attracted to the wires 5 which are earthed at one end and are at the potential of the low tension source at the other end, and is deposited on their surface to form a regular layer. From the beginning of the engagement of brushes 15 and 17 in rails 8 and 9, these wires are heated by a Joule effect as the result of the passage of a current from the source and their temperature therefore increases progressively as they move along rails 8 and 9. The wires 5 are driven perpendicularly to their longitudinal axes by the chains 2 and 3 and the motor M in the direction of arrow F, while the transport band 11 is driven in the direction of the arrow $F_1$.

As FIG. 1 shows, the beginning of the feed rails 8 and 9 is somewhat ahead of the passage of the wires 5 under the hopper 6, so that when they arrive below that hopper, the powder deposited on their surface is instantaneously softened under the action of the heating of the wire. Its temperature continues to increase for a time while the wire 5 moves towards the electrode 10 until it reaches a given value, which depends on the power of the source 10 and which is sufficient to produce a homogeneous layer of molten material on the surface of the wire. The choice of this temperature of course depends on the properties of the thermoplastic material used. As a variant, if it is not desired to cover the whole of the surface of the wires 5, the electrode 7 can be omitted or not connected to the electrostatic generator, and the heated wires can merely be passed below the hopper, so that the particles of powder touching the heated wire adhere to its surface.

When the molten dielectric material arrives opposite the electrode 10, the forces exerted on this material by the electrostatic field created between the electrodes 5 and 10 draw away a plurality of fibers which are deposited on the transfer band 11. In this example, the non-woven product formed by accumulation of these fibers is thereafter separated from the transfer band 11 by the scraper 14.

The use of electrodes arranged transversely to their direction of movement provides several advantages, especially that of making it possible to produce a continuous feed device by means of a plurality of electrodes. This arrangement makes it possible to provide each electrode separately and selectively with heating current. The width of the non-woven product made is in theory unlimited, the electrodes 5 and the distances between the chains 2 and 3 being selected as desired. The distance between successive electrodes 5 can be sufficiently small for the number of electrodes which simultaneously produce fibers to be considerable. The transversal movement of the electrodes relative to the area of deposition of the fibers facilitates a good homogeneity of the product obtained.

As an indication, it is for example possible to produce a non-woven of 100 g/m$^2$ at a speed of 10 m/min, each wire of length 1 meter having a layer of material of 0.5 g/m. The average depositing time of each wire is 5 seconds; the size of electrode 10 in the direction of movement of the wires 5 being 250 cm and the rate of passage of the wires being 2000/min, the speed of the feed device corresponding to 30 m/min, for a separation of the wires of 15 mm.

Figure 3:
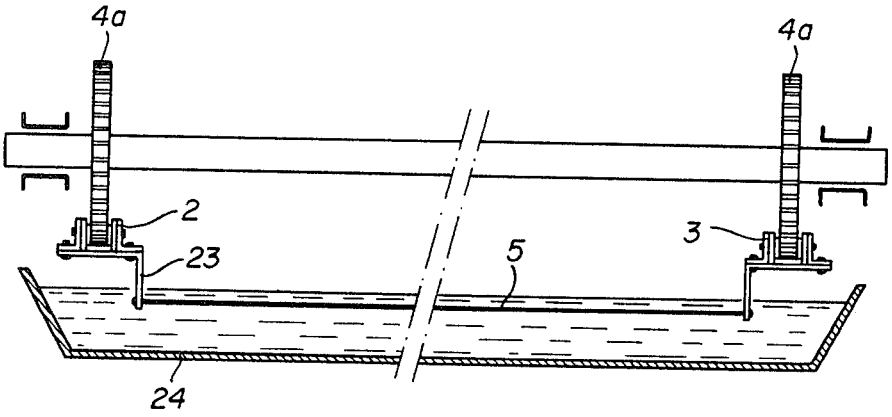
FIG. 3 is an enlarged section along III—III of FIG. 1 but representing a variant of the device, for producing a non-woven from a solution.

The variant illustrated in FIG. 3 was specially conceived with a view to the production of fibers from materials in solution. In such a case, it is not obligatory to heat the electrodes 5 carrying the material. Instead of spreading powder on these electrodes 5, they must be soaked in the solution which is intended to be subsequently pulverised in the electrostatic field.

A reservoir 24 containing a solution should be placed below the pair of sprockets 4*a* for each wire 5 to pass down in turn into the solution before passing opposite the fixed electrode 10. In this variant, the feed device 1 will be driven in the opposite direction from that indicated in FIG. 1.

The mounting of the wires 5 forming the electrodes on the chains 2 and 3 is effected via L-shaped members 23, each one being fixed by one of its sides to the respective chains, while the other side is directed outwardly and carries wire 5 at its end. The object of this mode of fixing is to space the wires 5 from the chains 2 and 3 so that the wires can pass through the solution contained in the reservoir 24 without the chains carrying the wires coming into contact with this solution.

The remainder of the apparatus is practically identical to that shown in FIGS. 1 and 2. Its operation consists simply in driving the chains 2 and 3 and the transfer band 11 with relative speeds appropriate to the thickness of the desired non-woven product. In this case, since the solutions used generally contain 90–95% of solvent, the yield is much lower so that the ratio between the speeds of the chains 2 and 3 and the transfer band 11 is to be altered accordingly.

I claim:

1. In a device for electrostatically forming filaments of a dielectric material and collecting said filaments as a nonwoven product comprising first and second spaced electrodes defining an elongated fiber-forming zone therebetween, an electrostatic generator operatively connected to one of said electrodes to establish an electrostatic field within said zone, means for supplying said dielectric material to one of said electrodes for conveyance into said zone to permit the electrostatic field within said zone to form filaments therefrom and means for collecting said electrostatically formed filaments as a nonwoven product and for continuously removing said nonwoven product from said zone, the combination wherein said first electrode comprises a plurality of discrete individual wire electrode segments extending transversely of said zone, said segments being aligned for successive movement longitudinally of said zone, said device including electrode transporting means for sequentially moving said first electrode segments longitudinally of said zone, said transporting means being electrically insulated from said electrode segments.

2. The device of claim 1 wherein said transporting means includes endless carrier belt means for conveying the first electrode along a closed path passing adjacent said supply means and said fiber-forming zone, and drive means operatively connected to said belt means to drive successive electrode segments longitudinally of said zone.

3. The device of claim 2 including electric current feed rail means extending along a portion of said closed path, said electrode segments being provided with electric contacts engageable with said rail means to cause said segments to be heated during movement along said path portion.

4. The device of claim 2 including elastic stretcher means interconnecting said wire electrode segements and said carrier belt means for accommodating variations in the length of each segment and maintaining said segments under tension during movement thereof along said closed path.

5. The device of claim 1 wherein said supply means includes a distributor for supplying said dielectric material to said first electrode upstream of said zone, and said device includes electric current feed rail means extending from a point on said path upstream of said distributor toward and into said zone, said rail means providing a connection with at least a portion of the wire electrode segments to permit heating of the segments to at least the softening temperature of said dielectric material.

6. The device of claim 5 wherein said supply means includes an electrode positioned within the field of flow of the dielectric material between the distributor and said wire electrode segments so as to give the material forming the flow an electrostatic charge whose potential is different from that of said wire segments.

7. The device of claim 1 for the manufacture of said product from a solution of said dielectric material including a reservoir for containing the solution positioned adjacent said fiber forming zone and adapted to immersably receive said electrode segments prior to entering said zone.

8. A process for the production of a non-woven product from a fluid dielectric substance, comprising forming a coating of the substance on a plurality of electrical conductive wires forming first electrodes stretching transversely between two endless transport bands, driving the bands synchronously to move the coated wires successively past a second electrode whose surface is relatively extensive with regard to the wires and establishing a potential difference between each wire while it passes the second electrode and the second electrode so as to create an electrostatic field which acts on the dielectric substance to form a plurality of fibers which are deposited as a non-woven web on a fiber collecting surface adjacent the second electrode.

9. A process according to claim 8 in which the fluid dielectric substance is formed by depositing on the wires a thermoplastic dielectric substance in powder form and passing an electric current through the wires so as to heat them by a Joule effect to at least the softening temperature of the thermoplastic dielectric material.

10. The process of claim 8 wherein said first electrodes and said second electrode move relative to each other in spaced parallel opposite directions.

* * * * *